US010349184B2

(12) United States Patent
Kuntzman et al.

(10) Patent No.: US 10,349,184 B2
(45) Date of Patent: Jul. 9, 2019

(54) MICROPHONE AND PRESSURE SENSOR

(71) Applicant: Knowles Electronics, LLC, Itasca, IL (US)

(72) Inventors: Michael Kuntzman, Chicago, IL (US); Wade Conklin, Chicago, IL (US); Sung Bok Lee, Chicago, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/424,602

(22) Filed: Feb. 3, 2017

(65) Prior Publication Data

US 2017/0230758 A1 Aug. 10, 2017

Related U.S. Application Data

(60) Provisional application No. 62/291,167, filed on Feb. 4, 2016.

(51) Int. Cl.

| | |
|---|---|
| ***H04R 1/28*** | (2006.01) |
| ***H04R 19/04*** | (2006.01) |
| ***H04R 29/00*** | (2006.01) |

(52) U.S. Cl.

CPC ..... *H04R 19/04* (2013.01); *H04R 1/2873* (2013.01); *H04R 29/004* (2013.01); *H04R 2201/003* (2013.01)

(58) Field of Classification Search

CPC .... H04R 19/04; H04R 29/004; H04R 1/2873; H04R 2201/003; H04R 19/005; H04R 19/016; H04R 7/00; H04R 7/04; H04R 1/08; H04R 23/00; B81B 7/02; B81B 2201/025; B81B 2201/0257; B81B 2201/0264; B81B 2207/012; B81B 7/0061; B81C 1/00158; B81C 1/00333

USPC ..... 257/418, 416, 415; 381/361

See application file for complete search history.

(56) References Cited

U.S. PATENT DOCUMENTS

| | | | |
|---|---|---|---|
| 7,190,038 | B2 | 3/2007 | Dehe et al. |
| 7,473,572 | B2 | 1/2009 | Dehe et al. |
| 7,781,249 | B2 | 8/2010 | Laming et al. |
| 7,795,695 | B2 | 9/2010 | Weigold et al. |
| 7,825,484 | B2 | 11/2010 | Martin et al. |

(Continued)

FOREIGN PATENT DOCUMENTS

WO WO-2012/122872 A1 9/2012

OTHER PUBLICATIONS

International Search Report and Written Opinion, PCT/US201/016537, Knowles Electronics, LLC, 10 pages (dated Apr. 5, 2017).

*Primary Examiner* — Yogeshkumar Patel
(74) *Attorney, Agent, or Firm* — Foley & Lardner LLP

(57) ABSTRACT

The present disclosure generally relates to acoustic assemblies. One acoustic assembly includes a base and a first die disposed on the base. The first die comprises a microelectromechanical system (MEMS) microphone that includes a first diaphragm and a first back plate. The MEMS microphone has a barometric release. The acoustic assembly also includes a second die disposed on the base. The second die comprises a pressure sensor. The acoustic assembly further includes a cover coupled to the base and enclosing the first dies and the second die. A back volume is formed between the base, the first die, the second die, and the cover. The pressure sensor is configured to sense a pressure of the back volume.

18 Claims, 3 Drawing Sheets

(56) References Cited

U.S. PATENT DOCUMENTS

| | | | | |
|---|---|---|---|---|
| 7,829,961 | B2 | 11/2010 | Hsiao | |
| 7,856,804 | B2 | 12/2010 | Laming et al. | |
| 7,903,831 | B2 | 3/2011 | Song | |
| 2005/0207605 | A1 | 9/2005 | Dehe et al. | |
| 2007/0007858 | A1* | 1/2007 | Sorensen | H04R 1/34 310/324 |
| 2007/0278501 | A1 | 12/2007 | MacPherson et al. | |
| 2008/0175418 | A1* | 7/2008 | Zhang | B81B 3/0027 381/174 |
| 2008/0175425 | A1 | 7/2008 | Roberts et al. | |
| 2008/0267431 | A1 | 10/2008 | Leidl et al. | |
| 2008/0279407 | A1 | 11/2008 | Pahl | |
| 2008/0283942 | A1 | 11/2008 | Huang et al. | |
| 2009/0001553 | A1 | 1/2009 | Pahl et al. | |
| 2009/0180655 | A1 | 7/2009 | Tien et al. | |
| 2010/0046780 | A1 | 2/2010 | Song | |
| 2010/0052082 | A1 | 3/2010 | Lee et al. | |
| 2010/0128914 | A1 | 5/2010 | Khenkin | |
| 2010/0183181 | A1 | 7/2010 | Wang | |
| 2010/0246877 | A1 | 9/2010 | Wang et al. | |
| 2010/0290644 | A1 | 11/2010 | Wu et al. | |
| 2010/0322443 | A1 | 12/2010 | Wu et al. | |
| 2010/0322451 | A1 | 12/2010 | Wu et al. | |
| 2011/0013787 | A1 | 1/2011 | Chang | |
| 2011/0075875 | A1 | 3/2011 | Wu et al. | |
| 2015/0158722 | A1* | 6/2015 | Lim | B81B 7/02 257/416 |
| 2015/0296305 | A1 | 10/2015 | Shao et al. | |
| 2016/0007119 | A1 | 1/2016 | Harrington | |

* cited by examiner

MICROPHONE AND PRESSURE SENSOR

CROSS-REFERENCE TO RELATED APPLICATIONS

The present application claims priority to and the benefit of U.S. Provisional Application No. 62/291,167 "MICROPHONE AND PRESSURE SENSOR," filed Feb. 4, 2016, the contents of which are incorporated by reference herein in their entirety.

TECHNICAL FIELD

This application relates to microphones and, more specifically, to microphones that include sensors.

BACKGROUND

Different types of acoustic devices have been used through the years. One type of device is a microphone. In many microelectromechanical system (MEMS) microphones, a MEMS die includes at least one diaphragm and at least one back plate. The MEMS die is supported by a substrate and enclosed by a housing (e.g., a cup or cover with walls). A port may extend through the substrate (for a bottom port device) or through the top of the housing (for a top port device). In any case, sound energy traverses through the port, moves the diaphragm and creates a changing potential of the back plate, which creates an electrical signal. Microphones are deployed in various types of devices such as personal computers or cellular phones.

Pressure sensors are also used to measure various types of pressures. Current microphones sometimes have a pierce in the diaphragm that allows for pressure equalization between the back volume and the ambient environment so that microphone sensitivity does not shift with changes in ambient pressure. This pierce is an acoustic high-pass filter making the microphone respond only to alternating current (AC) signals, while not responding to direct current (DC) or slowly varying (ambient pressure) signals. Thus, current microphones using this configuration do not generally include pressure sensors.

The problems of previous approaches have resulted in some user dissatisfaction with these previous approaches.

SUMMARY

One aspect of the disclosure relates to an acoustic assembly. The acoustic assembly includes a base and a first die disposed on the base. The first die comprises a microelectromechanical system (MEMS) microphone that includes a first diaphragm and a first back plate. The MEMS microphone has a barometric release. The acoustic assembly also includes a second die disposed on the base. The second die comprises a pressure sensor. The acoustic assembly further includes a cover coupled to the base and enclosing the first dies and the second die. A back volume is formed between the base, the first die, the second die, and the cover. The pressure sensor is configured to sense a pressure of the back volume.

Another aspect of the disclosure relates to an acoustic assembly. The acoustic assembly comprises a base and a die disposed on the base. The die comprises a microelectromechanical system (MEMS) microphone and a pressure sensor. The MEMS microphone includes a first diaphragm and a first back plate, and a barometric release. The acoustic assembly also comprises a cover coupled to the base and enclosing the die. A back volume is formed between the base, the die, and the cover. The pressure sensor is configured to sense a pressure of the back volume.

Yet another aspect of the disclosure relates to an acoustic assembly. The acoustic assembly comprises a base, a microelectromechanical system (MEMS) microphone disposed on the base, and a pressure sensor disposed on the base. The MEMS microphone comprises a first diaphragm and a first back plate. The acoustic assembly also includes an integrated circuit disposed on the base. The integrated circuit is electrically coupled to the MEMS microphone and the pressure sensor and configured to process signals generated by the MEMS microphone and the pressure sensor. The acoustic assembly further comprises a cover coupled to the base and enclosing the MEMS microphone, the pressure sensor, and the integrated circuit. A back volume is formed between the base and the cover. The pressure sensor is configured to sense a pressure of the back volume.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
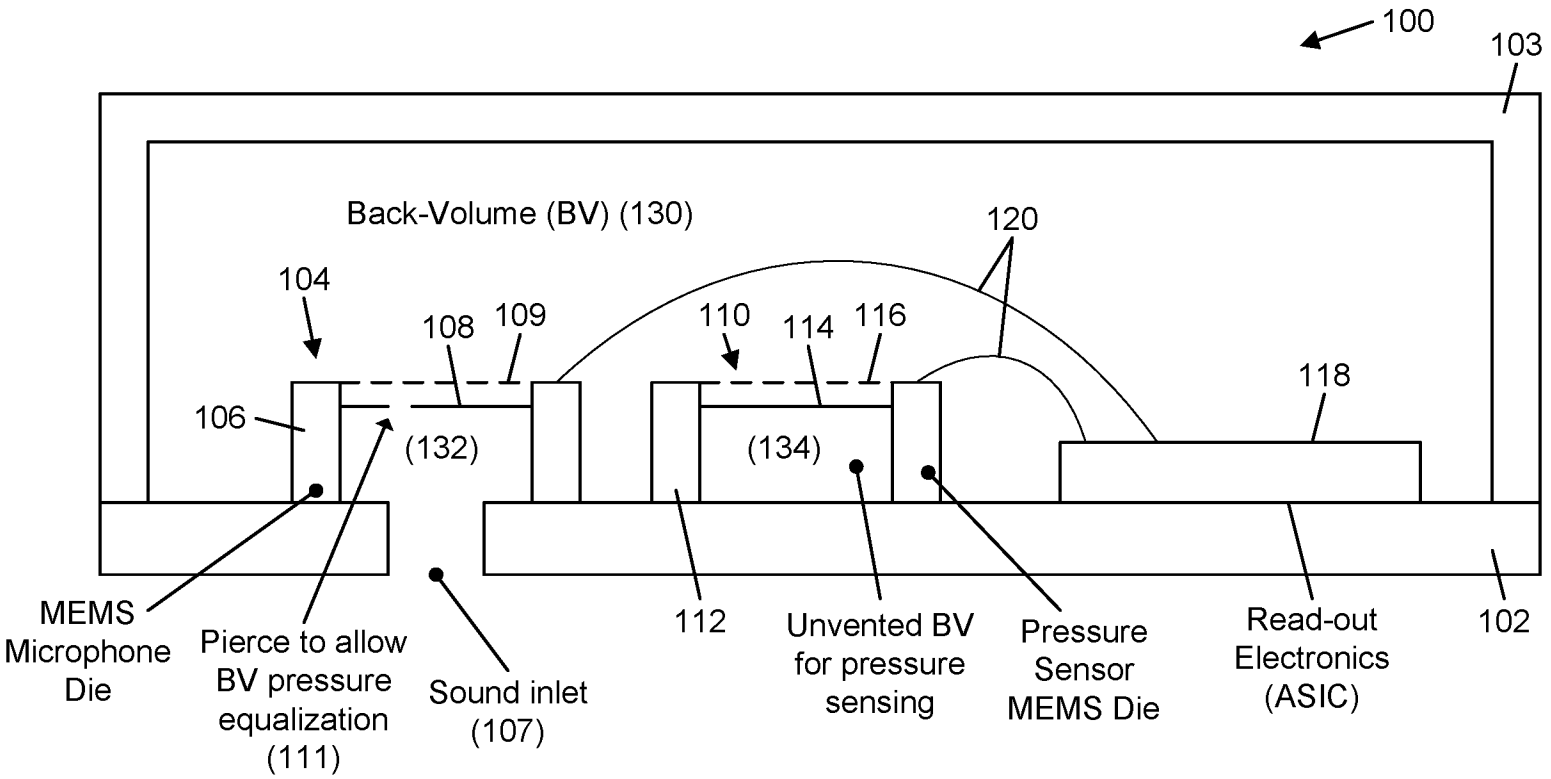
FIG. 1 is an integrated microphone and sensor assembly according to various embodiments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

The present disclosure provides a microphone that responds to both AC pressure signals and DC pressure signals. In other words, the microphones provided by the present disclosure allow the detection of acoustic energy and convert that acoustic energy into electric signals. These microphones also provide for the detection of ambient pressures and changes in ambient pressure (e.g., environmental pressures outside the microphone).

Many consumer electronic applications use both pressure sensors and microphones. The devices and methods described herein integrate microphones and pressure sensors to provide a single packaged device providing both functions.

In the present disclosure, the pressure sensor does not require direct access to the outside (ambient) environment, but instead can sense changes in absolute pressure of the microphone back volume, which is tied to the ambient environment. The pressure sensor has its own enclosed back volume, which functions as the reference pressure. This back volume can be defined by the etch cavity of the pressure sensor die. The pressure sensor can be implemented using a variety of different sensing technologies (e.g., capacitive, piezo resistive, to mention two examples).

The pressure sensor can be formed on a separate die or can be combined on the same die as the acoustic sensing element. The read-out electronics for both the acoustic sensor and the pressure sensor can be combined on a single integrated circuit, saving cost and space as compared to two completely independent sensors.

Referring now to FIG. 1, one example of an integrated microphone with pressure sensor assembly 100 is described. The assembly 100 includes a base 102 (e.g., a printed circuit board), a first microelectromechanical system (MEMS) die 104 (that includes a first substrate 106, a first diaphragm 108, and a first back plate 109), a second die 110 (pressure sensor) (that includes a second substrate 112, a second diaphragm 114, and a second back plate 116), an integrated circuit 118, and wires 120 coupling dies 104, 110 to integrated circuit 118 (which has processing electronics to read out signals from dies 104, 110). It will be appreciated that the second die 110 may comprise any type of pressure sensor, that is, the die 110 could be swapped out for other types of pressure sensors. For example, a piezoresistive pressure sensor (which would typically not have a back plate) and some capacitive pressure sensors (which may include a diaphragm pierce) may also be utilized. A cover 103 enclosed the dies 104 and 110.

A back volume 130 is formed between the cover 103, dies 104, 110, and base 102. A first front volume 132 is formed in first die 104. A volume 134 is formed under second die 110. A vent 111 pierces first diaphragm 108. The vent 111 may be used as a barometric release. In some embodiments, no vent pierces second diaphragm 114. The second diaphragm 114 is continuous and solid with no holes. However and as noted above, in some embodiments, some capacitive sensors that include pierces in the diaphragm may also be used.

Acoustic sound pressure enters through a port 107 (extending through base 102), moves the first diaphragm 108, produces changing electrical potential with first back plate 109, creates electrical signal, which is fed to integrated circuit 118. Vent 111 (i.e., barometric release) allows back volume pressure equalization to occur.

In some embodiments, the volume 134 is sealed and acts as a back volume holding a reference pressure. In other examples, the volume may not be sealed. As ambient pressure changes, second diaphragm 114 moves, with second back plate 116 creates changing electrical potential, which is converted to an electrical signal and sent to integrated circuit 118.

Advantageously, the pressure sensor (formed by the die 110) does not require direct access to the outside (ambient) environment, but instead can sense changes in absolute presence of the microphone back volume, which is tied to the ambient environment. The pressure sensor has its own enclosed back volume 134, which functions as the reference pressure.

Figure 2:
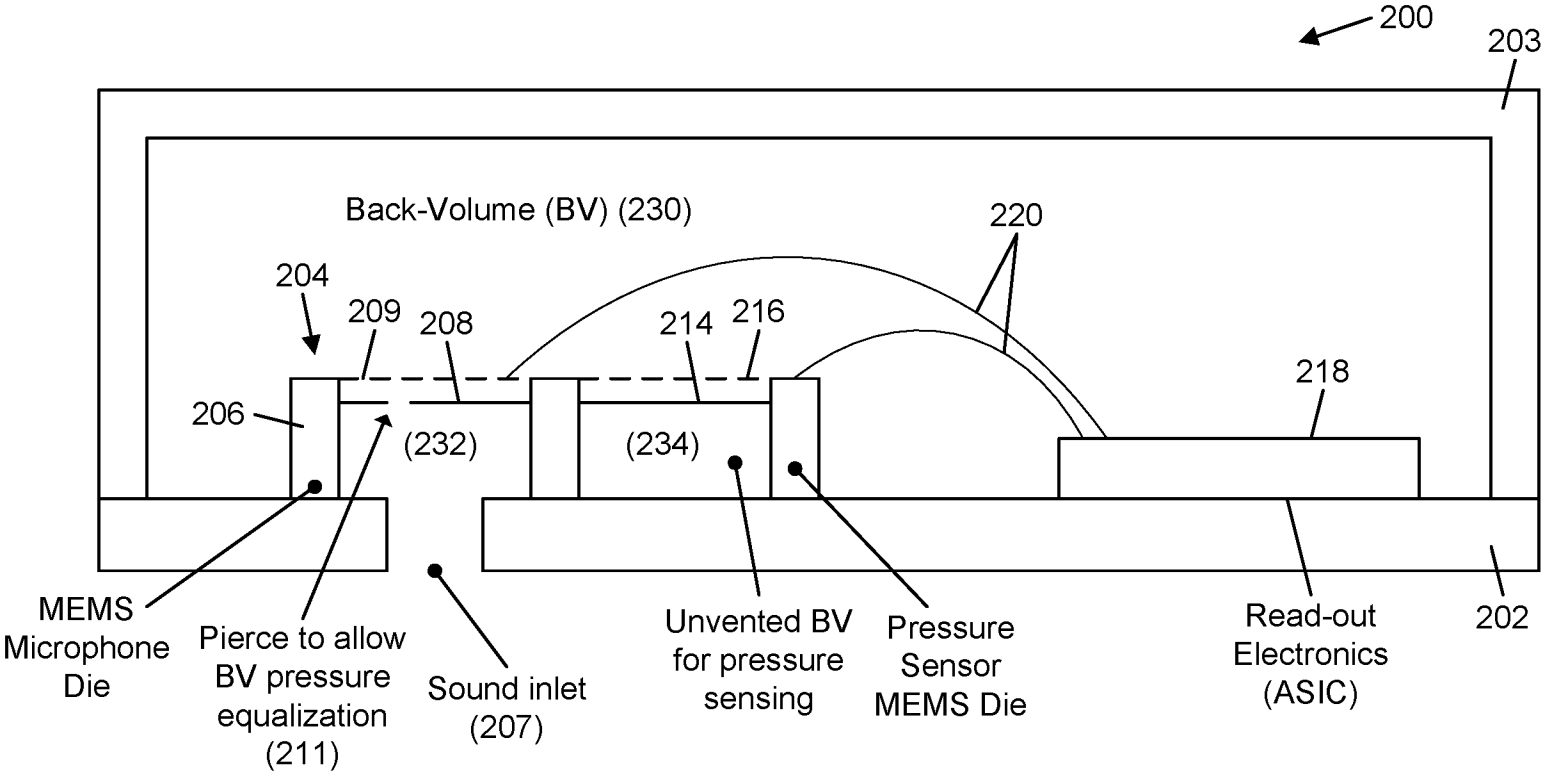
FIG. 2 is another microphone and sensor assembly according to various embodiments.

Referring now to FIG. 2, another example of an integrated microphone with pressure sensor assembly 200 is described. The assembly 200 includes a base 202 (e.g., a printed circuit board), a microelectromechanical system (MEMS) die 204 (that includes a substrate 206, a first diaphragm 208, a first back plate 209, a second diaphragm 214, and a second back plate 216), an integrated circuit 218, and wires 220 coupling die 204 to integrated circuit 218 (which has processing electronics to read out signals from die 204). It will be appreciated that the second back plate 216 may be omitted in some examples. For example, a piezoresistive pressure sensor may be formed (which would typically not have a back plate). A cover 203 enclosed the die 204.

A back volume 230 is formed between the cover 203, die 204, and base 202. A first front volume 232 is formed in die 204. A volume 234 is also formed under die 204. A vent 211 pierces first diaphragm 208. The vent 211 may be used as a barometric release. In some embodiments, no vent pierces second diaphragm 214 (the second diaphragm 214 is continuous and solid with no holes). In some examples, the second diaphragm 214 may include a pierce. In this case, the pressure sensor is formed on the same die as the acoustic sensing element.

Acoustic sound pressure enters through a port 207 (extending through base 202), moves the first diaphragm 208, produces changing electrical potential with first back plate 209, creates electrical signal, which is fed to integrated circuit 218. Vent 211 (i.e., barometric release) allows back volume pressure equalization to occur.

The volume 234 is sealed and acts as a back volume holding a reference pressure. As ambient pressure changes, second diaphragm 214 moves, with second back plate 216 creates changing electrical potential, which is converted to an electrical signal and sent to integrated circuit 218.

Advantageously, the pressure sensor formed by the die 210 does not require direct access to the outside (ambient) environment, but instead can sense changes in absolute pressure of the microphone back volume, which is tied to the ambient environment. The pressure sensor has its own enclosed back volume 234, which functions as the reference pressure.

Figure 3A:
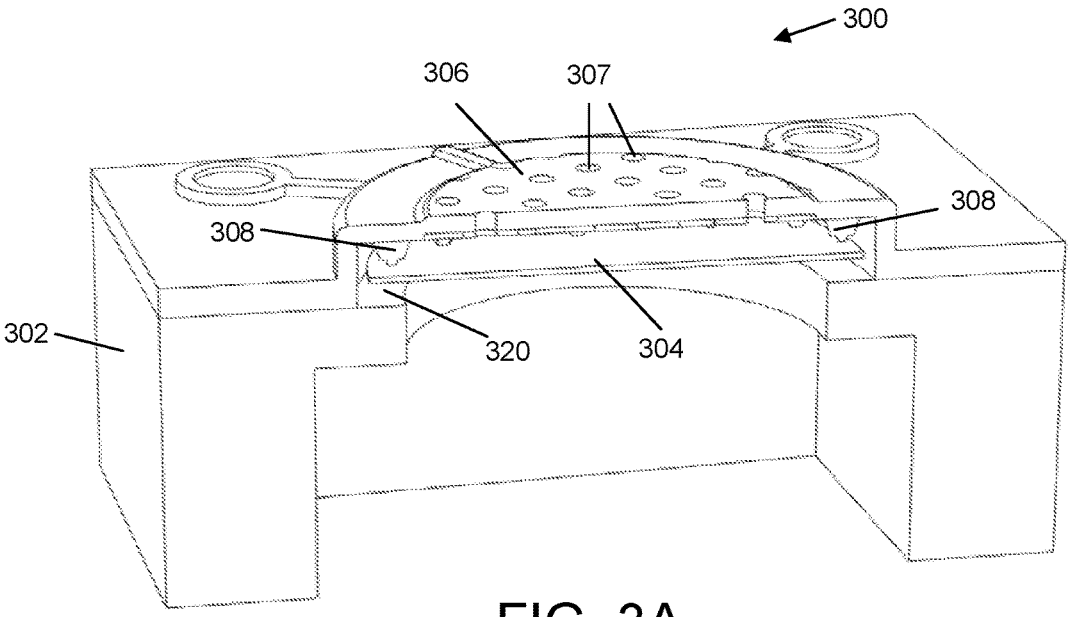
FIG. 3A is a perspective view of a microelectromechanical system (MEMS) microphone according to various embodiments.
Figure 3B:
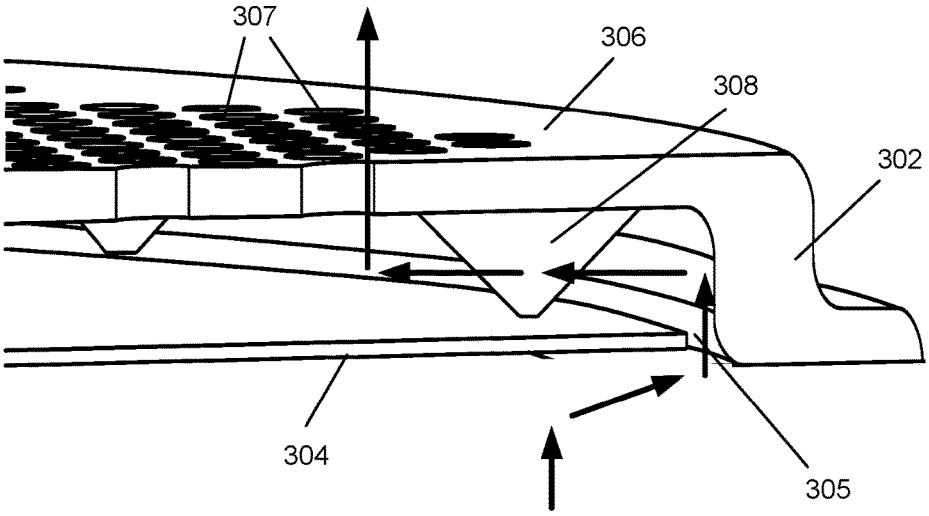
FIG. 3B is an enlarged view of a portion of the MEMS microphone of FIG. 3A.

Referring to FIG. 3A, a MEMS microphone 300 is shown according to various embodiments. FIG. 3B shows an enlarged view of a portion of the MEMS microphone 300 of FIG. 3A. The MEMS microphone 300 can be used in place of the MEMS microphone of FIG. 1 or FIG. 2 to integrate with a pressure sensor. In some implementations, the MEMS microphone 300 does not have a pierce on the diaphragm. An air gap surrounding at least a portion of the diaphragm is used as the barometric release for establishing the pressure equalization between the pressure of the back volume and the ambient pressure of air outside.

In particular, the MEMS microphone 300 comprises a diaphragm 304, a back plate 306 opposing the diaphragm 304, and a substrate 302 supporting the diaphragm 304 and the back plate 306. An aperture 320 is formed in the substrate 302 to accommodate the diaphragm 304. The substrate 302 may be constructed of a semiconductor material (e.g., silicon). The diaphragm 304 and the back plate 306 include conductive material. The diaphragm 304 is continuous and solid without holes, in some implementations. There is an air gap (or empty space) 305 between the diaphragm 304 and the substrate 302. For example, the diaphragm 304 may be a free plate diaphragm connected to the substrate 302 through one or more very thin tabs (not shown in the present figures). The diaphragm 304 is free to move within the aperture 320 where it is disposed. In some embodiments, the diaphragm 304 is smaller than the aperture 320 so that the air gap 305 is formed surrounding at least a portion of the diaphragm 304. In some embodiments, the diaphragm 304 has a different shape than the aperture 320 so that the air gap 305 is formed surrounding at least a portion of the diaphragm 304. For example, the aperture 320 may have a circular shape. The diaphragm 304 may have any suitable non-circular shape, such as square, rectangular, hexagon, oval, etc. In further embodiments, the back plate 306 may have one or more posts 308 protruding towards the diaphragm 304 and disposed around the periphery of the diaphragm 304. Movement of the diaphragm 304 may be restrained by the one or more posts 308. In some embodiments, a plurality of perforations 307 are formed on the back plate 306.

In operation, sound enters the MEMS microphone 300 through a port (e.g., port 107 or 207). The acoustic waves move the diaphragm 304 and electrical signals are produced reflecting the capacitance change between the diaphragm 304 and the back plate 306. On the other hand, air flow can leak around the diaphragm 304 through the air gap 305, then through the perforations 307 of the back plate 306, and reach a pressure sensor integrated with the MEMS microphone 300 (e.g., pressure sensor of FIG. 1 or FIG. 2). The flow path is shown by arrows in FIG. 3B. The air gap 305 and the perforations 307 enable pressure equalization between the environment and the back volume of the MEMS microphone 300 (e.g., back volume 130 or 230). In other words, the static or slowly varying atmospheric pressure can pass the MEMS microphone 300 through the barometric release (i.e., the air gap 305) and apply to the pressure sensor integrated with the MEMS microphone 300.

The herein described subject matter sometimes illustrates different components contained within, or connected with, different other components. It is to be understood that such depicted architectures are merely exemplary, and that in fact many other architectures can be implemented which achieve the same functionality.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An acoustic assembly, comprising:
a base;
a die disposed on the base and comprising a microelectromechanical system (MEMS) microphone and a pressure sensor, the MEMS microphone comprising a first diaphragm and a first back plate, the pressure sensor comprising a second diaphragm and a second back plate; and
a cover coupled to the base and enclosing the die;
wherein a back volume is formed between the base, the die, and the cover; and
wherein the pressure sensor is configured to sense a pressure of the back volume.

2. The acoustic assembly of claim 1, wherein a port extends through the base, and wherein a pressure equalization is established between a pressure of the back volume and an ambient pressure of air outside the acoustic assembly through a barometric release.

3. The acoustic assembly of claim 1, wherein the MEMS microphone further comprises a substrate for supporting the first diaphragm and the first back plate, the substrate has an aperture for accommodating the first diaphragm, and the first diaphragm is smaller than the aperture.

4. The acoustic assembly of claim 1, wherein the MEMS microphone further comprises a substrate for supporting the first diaphragm and the first back plate, the substrate has an aperture for accommodating the first diaphragm, and a shape of the aperture is different from a shape of the first diaphragm.

5. The acoustic assembly of claim 1, further comprising an integrated circuit disposed on the base, wherein the integrated circuit is electrically coupled to the die and configured to process signals generated by the MEMS microphone and the pressure sensor.

6. The acoustic assembly of claim, 1 wherein the second diaphragm is continuous without a hole, a sealed back volume is formed between the pressure sensor and the base, and the sealed back volume holds a reference pressure.

7. The acoustic assembly of claim 6, wherein the reference pressure is kept constant.

8. The acoustic assembly of claim 6, wherein the sealed back volume is formed by an etch cavity of the die.

9. An acoustic assembly, comprising:
a base;

a die disposed on the base and comprising a microelectromechanical system (MEMS) microphone and a pressure sensor, the MEMS microphone comprising a first diaphragm and a first back plate, wherein the MEMS microphone has a barometric release comprising an air gap surrounding at least a portion of the first diaphragm; and a cover coupled to the base and enclosing the die;

wherein a back volume is formed between the base, the die, and the cover; and wherein the pressure sensor is configured to sense a pressure of the back volume.

10. The acoustic assembly of claim 9, wherein a port extends through the base, and wherein a pressure equalization is established between a pressure of the back volume and an ambient pressure of air outside the acoustic assembly through the barometric release.

11. The acoustic assembly of claim 9, wherein the MEMS microphone further comprises a substrate for supporting the first diaphragm and the first back plate, the substrate has an aperture for accommodating the first diaphragm, and the first diaphragm is smaller than the aperture.

12. The acoustic assembly of claim 9, wherein the MEMS microphone further comprises a substrate for supporting the first diaphragm and the first back plate, the substrate has an aperture for accommodating the first diaphragm, and a shape of the aperture is different from a shape of the first diaphragm.

13. The acoustic assembly of claim 9, further comprising an integrated circuit disposed on the base, wherein the integrated circuit is electrically coupled to the die and configured to process signals generated by the MEMS microphone and the pressure sensor.

14. The acoustic assembly of claim 9, wherein the MEMS microphone is formed on a first portion of the die, and the pressure sensor is formed on a second portion of the die side-by-side with the MEMS microphone.

15. The acoustic assembly of claim 14, wherein the second portion of the die includes a second diaphragm and a second back plate, the second diaphragm is continuous without a hole, a sealed back volume is formed between the second portion of the die and the base, and the sealed back volume holds a reference pressure.

16. An acoustic assembly, comprising:

a base;

a microelectromechanical system (MEMS) microphone disposed on the base, the MEMS microphone comprising a first diaphragm and a first back plate, wherein the MEMS microphone has a barometric release comprising an air gap surrounding at least a portion of the first diaphragm;

a pressure sensor disposed on the base, the pressure sensor and the MEMS microphone disposed on a single die;

an integrated circuit disposed on the base, wherein the integrated circuit is electrically coupled to the MEMS microphone and the pressure sensor and configured to process signals generated by the MEMS microphone and the pressure sensor; and a cover coupled to the base and enclosing the MEMS microphone, the pressure sensor, and the integrated circuit;

wherein a back volume is formed between the base and the cover; and wherein the pressure sensor is configured to sense a pressure of the back volume.

17. The acoustic assembly of claim 16, wherein a pressure equalization is established between a pressure of the back volume and an ambient pressure of air outside the acoustic assembly through the barometric release.

18. The acoustic assembly of claim 1, wherein the MEMS microphone and the pressure sensor share a common substrate, and wherein the first diaphragm, the first backplate, the second diaphragm, and the second backplate are each coupled to the common substrate.

* * * * *